US012042059B2

(12) United States Patent
Sin et al.

(10) Patent No.: US 12,042,059 B2
(45) Date of Patent: Jul. 23, 2024

(54) HEAD SUPPORT ASSEMBLY

(71) Applicant: SECRETLAB SG PTE. LTD., Singapore (SG)

(72) Inventors: Vincent Sin, Singapore (SG); Jon Hao Chan, Singapore (SG); Gabriel Lim, Singapore (SG); Elroy Cheng Feng Lee, Singapore (SG); Hong Kai Lam, Singapore (SG)

(73) Assignee: SECRETLAB SG PTE. LTD., Singapore (SG)

( * ) Notice: Subject to any disclaimer, the term of this patent is extended or adjusted under 35 U.S.C. 154(b) by 110 days.

(21) Appl. No.: 17/856,135

(22) Filed: Jul. 1, 2022

(65) Prior Publication Data

US 2023/0000255 A1 Jan. 5, 2023

(30) Foreign Application Priority Data

Jul. 5, 2021 (SG) ..... 10202107385U

(51) Int. Cl.
*A47C 7/38* (2006.01)

(52) U.S. Cl.
CPC ..... *A47C 7/383* (2013.01)

(58) Field of Classification Search
CPC ..... B60N 2/806; B60N 2/882; A47C 7/383
See application file for complete search history.

(56) References Cited

U.S. PATENT DOCUMENTS

| | | | | |
|---|---|---|---|---|
| 2015/0013072 | A1* | 1/2015 | Clarke | B60N 2/882 5/636 |
| 2019/0313724 | A1 | 10/2019 | Jackson | |
| 2019/0328180 | A1* | 10/2019 | Helgert | A47K 3/001 |

FOREIGN PATENT DOCUMENTS

| | | | | |
|---|---|---|---|---|
| CN | 2693091 | Y | 4/2005 | |
| CN | 211559453 | U | 9/2020 | |
| CN | 212165382 | U | * 12/2020 | |
| CN | 214711598 | U | 11/2021 | |
| KR | 2021061076 | A | * 5/2021 | A47C 7/383 |
| KR | 20210061076 | A | 5/2021 | |

OTHER PUBLICATIONS

Extended European Search Report for EP Appl. No. 22183039.1, dated Nov. 25, 2022.
International Search Report and Written Opinion for SG Appl. No. 10202107385U, dated Jan. 11, 2022.
Communication pursuant to Article 94(3) EPC for EP Appl. No. 22183039.1, dated Jan. 30, 2024.
Notice of Eligibility and Examination Report on SG Appl. No. 10202107385U, dated Feb. 5, 2024.
Communication pursuant to Rule 114(2) EPC on EP Appl. No. 22183039.1, dated Feb. 21, 2024.

* cited by examiner

*Primary Examiner* — Milton Nelson, Jr.
(74) *Attorney, Agent, or Firm* — Foley & Lardner LLP

(57) ABSTRACT

A head support assembly and a method of supporting a cushion on a headrest are disclosed. The head support assembly comprises a headrest extending upwardly from a seatback, the headrest comprising one or more magnetizable plate members; a cushion adjustable between a first position and a second position relative to the headrest, the cushion comprising a plurality of magnets, wherein the one or more magnetizable plate members and the plurality of magnets are configured to magnetically attach the cushion to the headrest for supporting the cushion at the first or second position.

14 Claims, 10 Drawing Sheets

HEAD SUPPORT ASSEMBLY

CROSS-REFERENCE TO RELATED APPLICATIONS

The present application claims priority to, and the benefit of, Singapore Patent Application No. 10202107385U, filed on Jul. 5, 2021.

FIELD OF INVENTION

The present invention relates broadly, but not exclusively, to a head support assembly and method of supporting a cushion on a headrest.

BACKGROUND

A typical seat head cushion or pillow is attached to a chair using an integrated elastic strap or Velcro strap and a user subsequently adjusts the head cushion/pillow to their desired position. However, the elastic strap may re-position the cushion/pillow to an unstretched position due to the nature of the strap's elasticity even after adjustment. Furthermore, the strap loses its elasticity after prolonged stretching and relaxing cycles, and thus the cushion/pillow may be loosely attached to the chair.

Current elastic straps also restrict the adjustability of the cushion/pillow. In addition, the use of elastic or Velcro straps may not look good aesthetically as the elasticity of the straps is lost after using for a period of time.

Accordingly, a need exists to provide a head support assembly that seeks to address some of the above problems.

SUMMARY

According to a first aspect of the present invention, there is provided a head support assembly comprising: a headrest extending upwardly from a seatback, the headrest comprising one or more magnetizable plate members; a cushion adjustable between a first position and a second position relative to the headrest, the cushion comprising a plurality of magnets, wherein the one or more magnetizable plate members and the plurality of magnets are configured to magnetically attach the cushion to the headrest for supporting the cushion at the first or second position.

In an embodiment, the cushion comprises a deformable fore section and a substantially flat aft section, wherein the fore section is configured to support a head of a user and the aft section is configured to slidingly abut a substantially flat fore surface of the headrest.

In an embodiment, the cushion further comprises a carrier member removably attached to the aft section, the carrier member configured to securely retain the plurality of magnets such that the magnets are disposed at the aft section proximate to the one or more magnetizable plate members of the headrest.

In an embodiment, the one or more magnetizable plate members are embedded adjacent the fore surface of the headrest.

In an embodiment, each magnet of the plurality of magnets comprises a base and a protrusion extending from the base, the protrusion having a cross-section smaller than a cross-section of the base.

In an embodiment, the carrier member comprises a plurality of cavities corresponding to the plurality of magnets, each cavity comprising an opening sized based on the cross-section of the protrusion, and wherein the magnets are disposed in the cavities such that the protrusion of each magnet is snugly received by a respective opening.

In an embodiment, the carrier member comprises a resilient material.

In an embodiment, the cushion comprises a plurality of recesses corresponding to the plurality of cavities, each recess based on the cross-section of the base, and wherein the magnets are disposed in the recesses such that the base of each magnet is snugly received by a respective recess.

According to a second aspect of the present invention, there is provided a method of supporting a cushion on a headrest, the cushion being adjustable between a first position and a second position relative to the headrest, the method comprising: embedding one or more magnetizable plate members into the headrest, the headrest extending upwardly from a seatback; disposing a plurality of magnets in the cushion; and placing the cushion against the headrest such that the one or more magnetizable plate members and the plurality of magnets magnetically attach the cushion to the headrest for supporting the cushion at the first or second position.

In an embodiment, the cushion comprises a deformable fore section and a substantially flat aft section, the fore section configured to support a head of a user, and wherein placing the cushion against the headrest comprises slidingly abutting the aft section with a substantially flat fore surface of the headrest.

In an embodiment, the cushion further comprises a carrier member removably attached to the aft section, and wherein disposing the plurality of magnets in the cushion comprises securely retaining magnets in the carrier member at the aft section proximate to the one or more magnetizable plate members of the headrest.

In an embodiment, embedding the one or more magnetizable plate members into the headrest comprises positioning the one or more magnetizable plate members adjacent the fore surface of the headrest.

In an embodiment, disposing the plurality of magnets in the cushion comprises: forming in the carrier member a plurality of cavities corresponding to the plurality of magnets, each cavity comprising an opening sized based on the cross-section of the protrusion; and disposing the magnets in the cavities such that the protrusion of each magnet is snugly received by a respective opening.

In an embodiment, the method further comprises forming a plurality of recesses corresponding to the plurality of cavities, each recess based on the cross-section of the base, and disposing the magnets in the recesses such that the base of each magnet is snugly received by a respective recess.

In an embodiment, wherein disposing the plurality of magnets in the pillow further comprises positioning the magnets based on a position of the one or more plate member on the headrest.

In an embodiment, the method further comprises selecting a magnetic strength of the magnets based on a weight of the cushion.

BRIEF DESCRIPTION OF THE DRAWINGS

Embodiments of the invention will be better understood and readily apparent to one of ordinary skill in the art from the following written description, by way of example only, and in conjunction with the drawings, in which.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description. Herein, a head support assembly is presented in accordance with present embodiments which may have the advantages of having a clean and neat cushion/pillow that can be securely attached to a chair while being able to be easily adjusted at the same time.

Figure 1A:
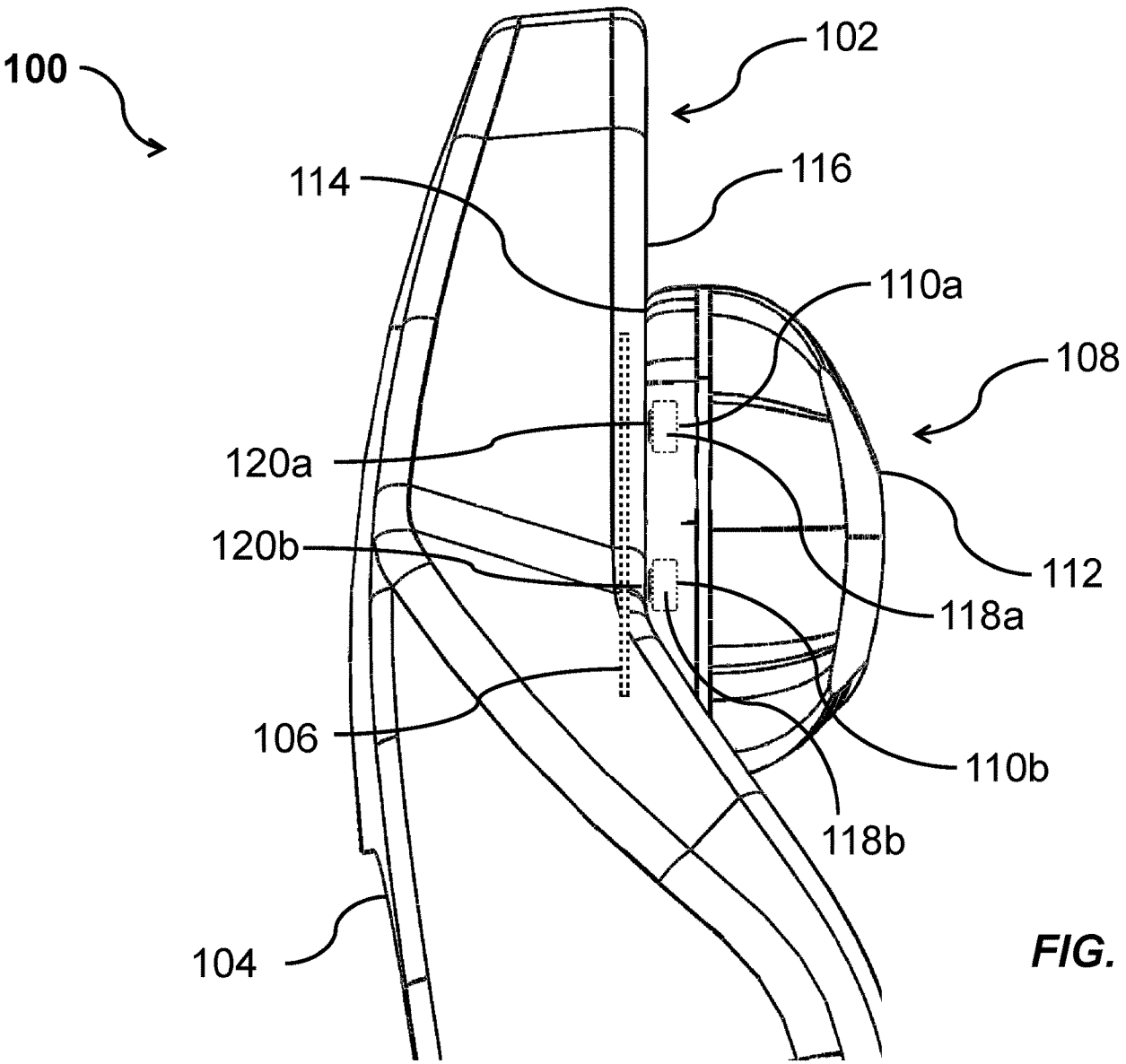
FIG. 1A shows a side view of a head support assembly, according to an example embodiment.

FIG. 1A shows a side view of a head support assembly 100, according to an example embodiment. In FIG. 1A, embedded or occluded elements are shown in broken lines. The head support assembly 100 includes a headrest 102 extending upwardly from a seatback 104, the headrest 102 comprising one or more magnetizable plate members 106. The head support assembly 100 also includes a cushion 108 adjustable between a first position and a second position relative to the headrest 102 (shown in FIGS. 1B and 1C). The cushion 108 includes a plurality of magnets 110*a*, 110*b* such that the one or more magnetizable plate members 106 and the plurality of magnets 110*a*, 110*b* are configured to magnetically attach the cushion 108 to the headrest 102 for supporting the cushion 108 at the first or second position. In other words, the magnetic force between the magnets 110*a*, 110*b* and the plate members 106 can support the weight of the cushion 108 at the first or second position.

Figure 2A:
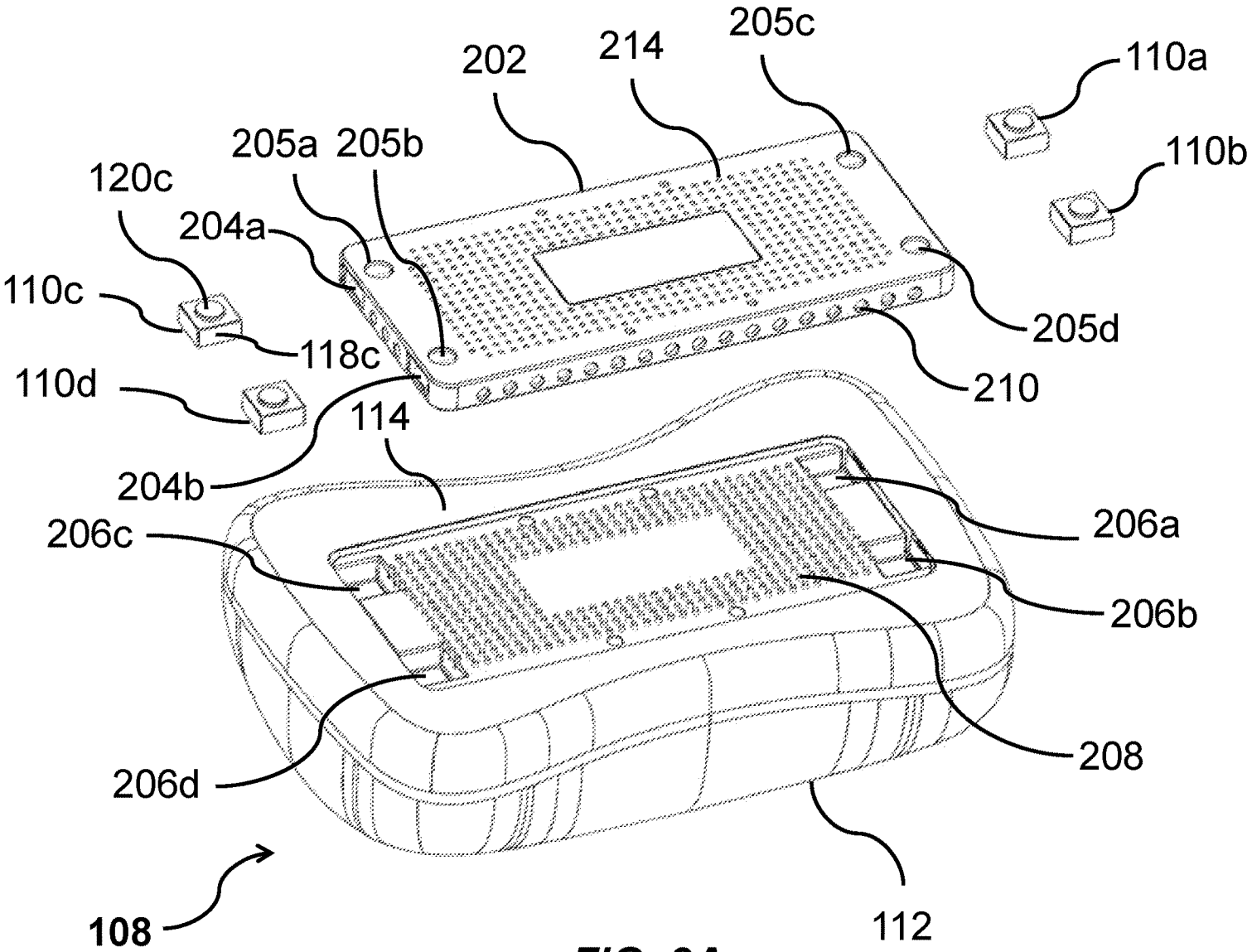
FIG. 2A shows an exploded perspective view of the cushion of the head support assembly of FIG. 1A, according to an example embodiment.

The cushion 108 includes a deformable fore section 112 and a substantially flat aft section 114, whereby the fore section 112 is configured to support a head of a user (not shown) and the aft section 114 is configured to slidingly abut a substantially flat fore surface 116 of the headrest 102. The one or more magnetizable plate members 106 are embedded adjacent the fore surface 116 of the headrest 102. Each of the plurality of magnets 110*a*, 110*b* includes a base 118*a*, 118*b* and a protrusion 120*a*, 120*b* extending from the base 118*a*, 118*b*, whereby the protrusion 120*a*, 120*b* has a cross-section smaller than a cross-section of the base 118*a*, 118*b*. A more detailed view of the base 118*a*, 118*b* and the protrusion 120*a*, 120*b* is shown in FIG. 2A. Even though two magnets 110*a*, 110*b* are shown in this Figure, it can be appreciated that more than two magnets are possible, for example, four magnets as shown in FIG. 2A, to better attach and support the cushion 108 to the headrest 102. The strength and/or positions of the magnets 110*a*, 110*b* may be selected based on practical requirements, e.g. number of magnets used, weight of the cushion 108, etc.

In example embodiments, the magnets 110*a*, 110*b* magnetically attach the cushion 108 to the headrest 102 by having the magnet protrusions 120*a*, 120*b* adjacent to the one or more magnetizable plate members 106. The magnetic force of the magnets 110*a*, 110*b* can be sufficiently strong to ensure that the cushion 108 is attached to the headrest 102 without having any physical and mechanical interaction. At the same time, the plurality of magnets 110*a*, 110*b* are securely held in place by the cushion 108 and are not dislodged when the cushion 108 is magnetically attracted to the one or more magnetizable plate members 106.

Figure 1B:
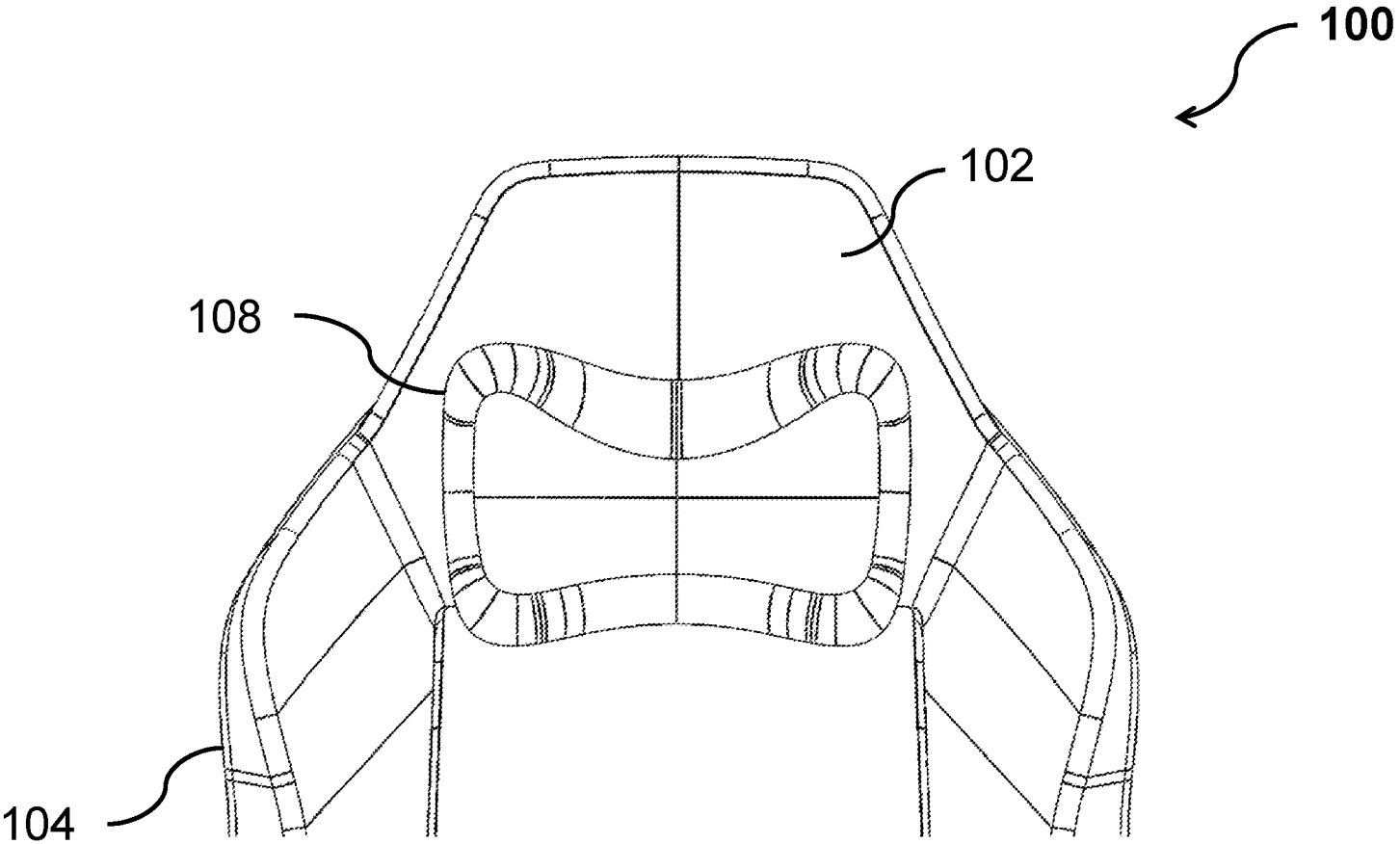
FIGS. 1B to 1C show perspective front views of the head support assembly of FIG. 1A with the cushion at a first and second position, respectively, relative to the headrest, according to an example embodiment.
Figure 1C:
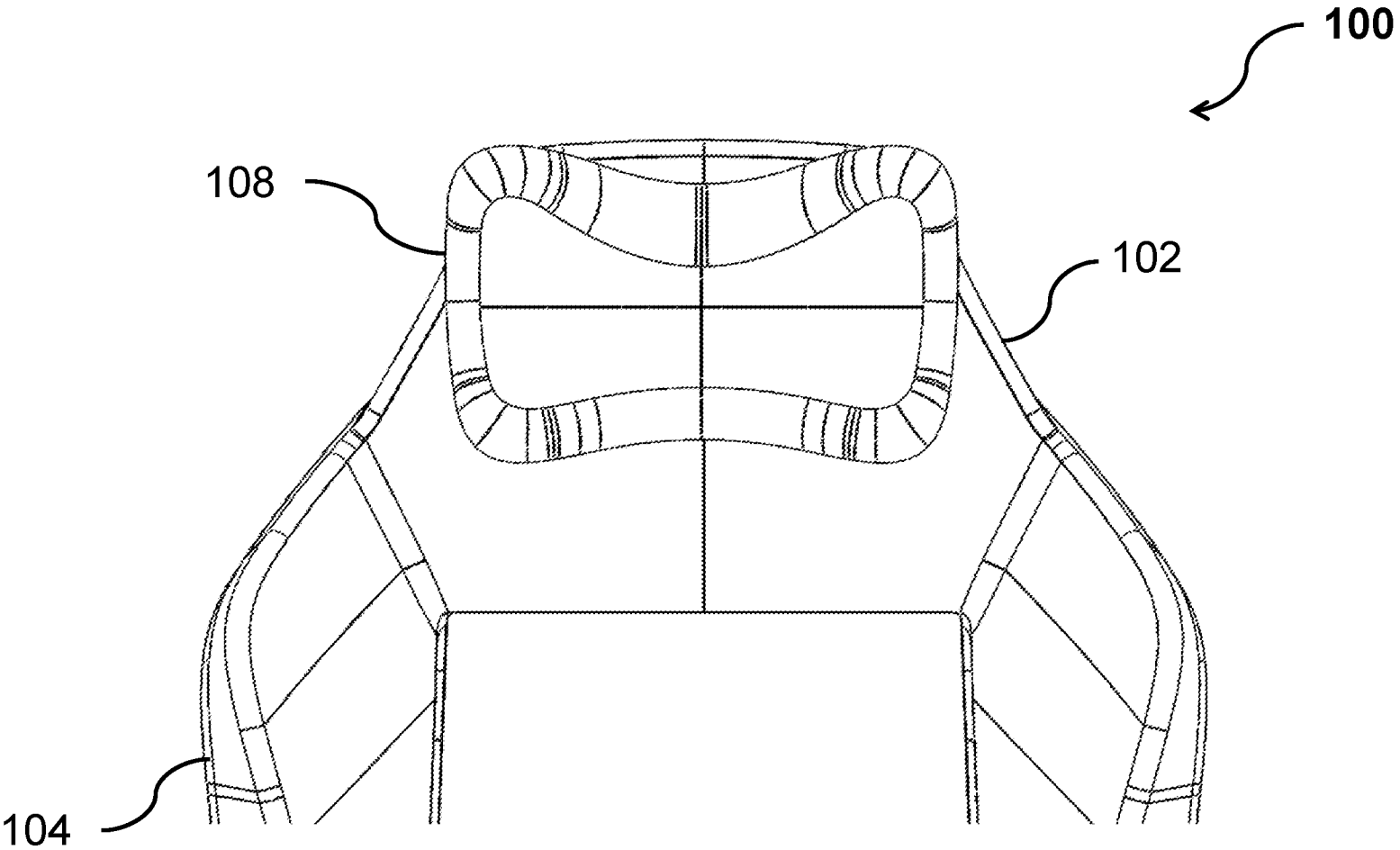

FIGS. 1B to 1C show perspective front views of the head support assembly 100 of FIG. 1A with the cushion 108 at a first and second position, respectively, relative to the headrest 102, according to an example embodiment. In FIG. 1B, the cushion 108 is magnetically attached to the headrest 102 at a first position. If a user finds that the cushion 108 is too low, he may adjust the cushion 108 to a second position above the first position as shown in FIG. 1C. As the cushion 108 is magnetically attached to the headrest 102 without the use of physical or mechanical means, the cushion 108 can be easily adjusted by the user between the first position and the second position. It can be appreciated that the user can adjust the cushion 108 to various positions along the one or more magnetizable plate members 106 and not limited to only the first and second positions. The plurality of magnets 110*a*, 110*b* can be selected to include dimensions, magnetic strength and maximum temperature characteristics based on the weight of the cushion 108. This may ensure sufficient magnetic force to support the cushion 108 at the first or second position.

FIG. 2A shows an exploded perspective view of the cushion 108 of the head support assembly 100 of FIG. 1A, according to an example embodiment. As shown in FIG. 2A, the cushion 108 includes a carrier member 202 removably attached to the aft section 114, the carrier member 202 configured to securely retain the plurality of magnets 110*a*, 110*b*, 110*c*, 110*d* such that the magnets are disposed at the aft section 114 proximate to the one or more magnetizable plate members 106 of the headrest 102. As described previously, each of the plurality of magnets 110*a*, 110*b* includes a base 118 and a protrusion 120 extending from the base 118 such that the protrusion 120 has a cross-section smaller than a cross-section of the base 118. In this example, the magnet protrusion 120 is circular while the base 118 is cuboid. However, it will be appreciated that the protrusion 120 and base 118 may have different shapes in alternate embodiments. Each magnet 110*a*, 110*b*, 110*c*, 110*d* has a body shaped with different cross-sections so that the carrier member 202 can secure the magnet 110*a*, 110*b*, 110*c*, 110*d* inside the cushion 108 by retaining the base of the magnet 110*a*, 110*b*, 110*c*, 110*d* while allowing the protrusion to be as close to the magnetizable plate members 106 (FIG. 1A) as possible to maximise the attractive forces.

The carrier member 202 may be a resilient material and includes a plurality of cavities 204*a*, 204*b*, corresponding to the plurality of magnets 110*a*, 110*b*, 110*c*, 110*d*. Each cavity 204 includes an opening 205*a*, 205*b*, 205*c*, 205*d* sized based on the cross-section of the protrusion 120. In this way, the magnets 110*a*, 110*b*, 110*c*, 110*d* are disposed in the cavities 204*a*, 204*b* such that the protrusion 120 of each magnet is snugly received by a respective opening 205*a*, 205*b*, 205*c*, 205*d*.

The cushion 108 may also include a plurality of recesses 206*a*, 206*b*, 206*c*, 206*d* corresponding to the plurality of cavities 204*a*, 204*b*. Each recess 206 is sized based on the cross-section of the base 118 and a layer of resilient material forming the cavities 204*a*, 204*b* surrounding the base 118, whereby the magnets 110*a*, 110*b*, 110*c*, 110*d* together with the resilient material are disposed in the recesses 206*a*, 206*b*, 206*c*, 206*d* such that the base 118 of each magnet 110 together with the resilient material is snugly received by a respective recess 206.

In an alternative embodiment, the magnets 110*a*, 110*b*, 110*c*, 110*d* can be shaped with a uniform cross-section and fixedly mounted onto the plurality of recesses 206*a*, 206*b*, 206*c*, 206*d* so that the magnets 110*a*, 110*b*, 110*c*, 110*d* remain in position when the cushion 108 is magnetically attached to the headrest 102. Accordingly, the magnets 110*a*, 110*b*, 110*c*, 110*d* can have other shapes and sizes such that they are in proximity to the magnetizable plate members 106.

The carrier member 202 may be removably attached to the cushion 108 via attaching means 208. The attaching means 208 may be conventional attaching means, for example Velcro, but can include other types such as tape or pin-and-hole to securely attach the carrier member 202 to the cushion 108. In an example embodiment, the carrier member 202 can be designed with multiple undercuts and holes 210 to create sufficient mechanical bonding with the cushion 108. The carrier member 202 can also include apertures 214 which may reduce the presence of trapped air during over-molding to provide the user a softer feeling.

Figure 2B:
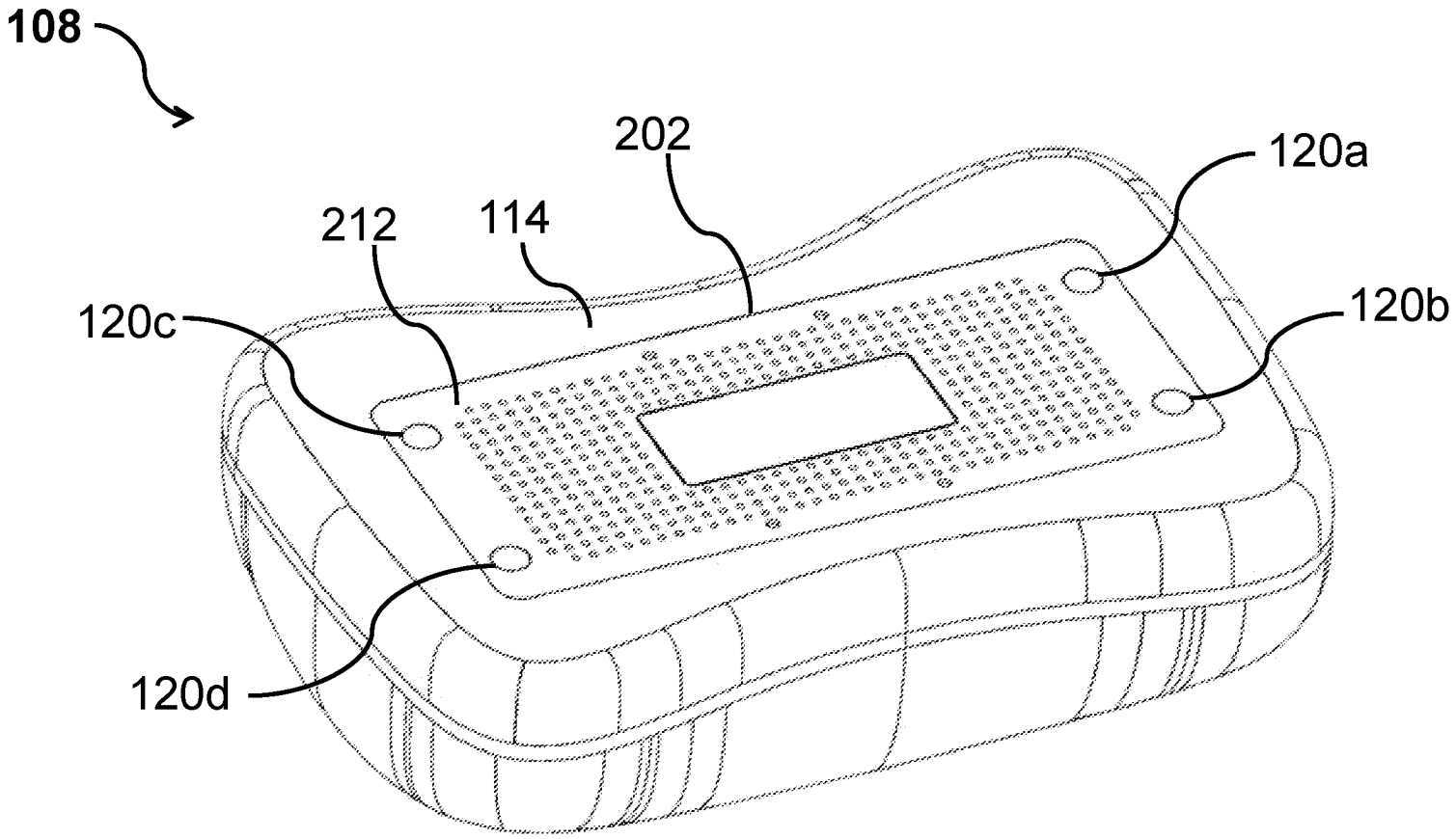
FIG. 2B shows a perspective view of the assembled cushion of the head support assembly of FIG. 1A, according to an example embodiment.

FIG. 2B shows a perspective view of the assembled cushion 108 of the head support assembly 100 of FIG. 1A, according to an example embodiment. In FIG. 2B, the plurality of magnets 110*a*, 110*b*, 110*c*, 110*d* are assembled into the recesses 206*a*, 206*b*, 206*c*, 206*d* of the cushion 108. The magnet protrusions 120 are received by the openings 205*a*, 205*b*, 205*c*, 205*d* of the carrier member 202 such that they are flushed with an aft surface 212 of the carrier member 202. When assembled, the aft surface 212 of the carrier member 202 and the aft section 114 of the cushion 108 are also flushed and substantially flat to allow strong magnetic interaction between the magnets 110*a*, 110*b*, 110*c*, 110*d* and the magnetizable plate members 106. The magnet protrusions 120 are thus proximate to one or more magnetizable plate members 106 (shown in FIG. 1A). The strong magnetic attraction may thus prevent the cushion 108 from sagging or falling off from the magnetizable plate members 106 as the centre of gravity is closer to a magnetic plane.

Figures 2C, 2D:
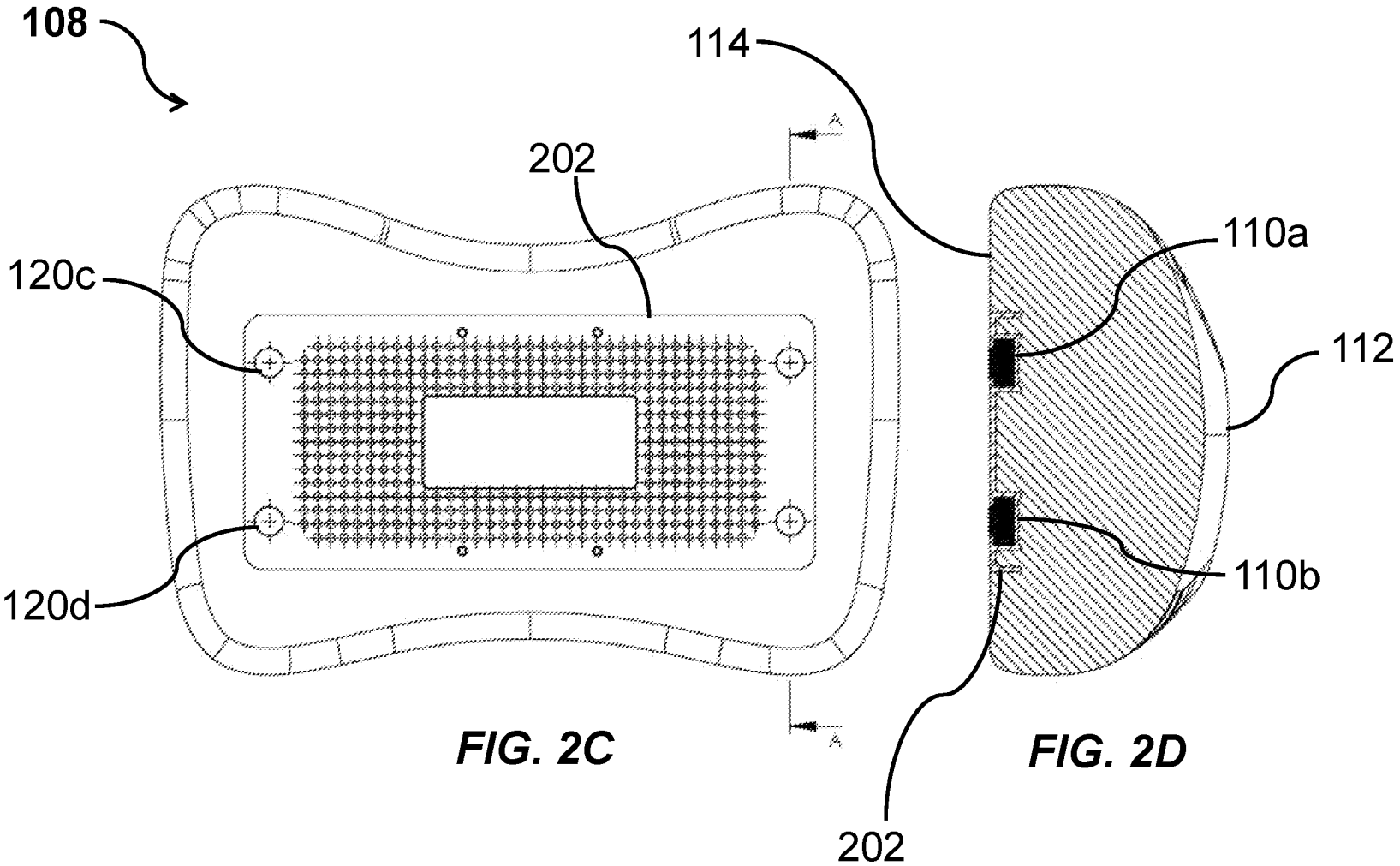
FIG. 2C shows a rear view of the assembled cushion of the head support assembly of FIG. 2B, according to an example embodiment.
FIG. 2D shows a cross-sectional view taken about the line A-A of the head support assembly of FIG. 2C, according to an example embodiment.

FIG. 2C shows a rear view of the assembled cushion 108 of FIG. 2B while FIG. 2D shows a cross-sectional view taken about the line A-A of the assembled cushion 108 of FIG. 2C, according to an example embodiment. In FIG. 2D, the carrier member 202 is shaped and disposed within the recesses 206*a*, 206*b*, 206*c*, 206*d* while securely retaining the plurality of magnets 110*a*, 110*b* within the plurality of cavities 204*a*, 204*b*. This may ensure that the protrusions 120*c*, 120*d* are flushed with the aft section 114 of the cushion 108, resulting in the magnets 110*a*, 110*b* being proximate to the one or more magnetizable plate members 106 (shown in FIG. 1A).

Figure 2E:
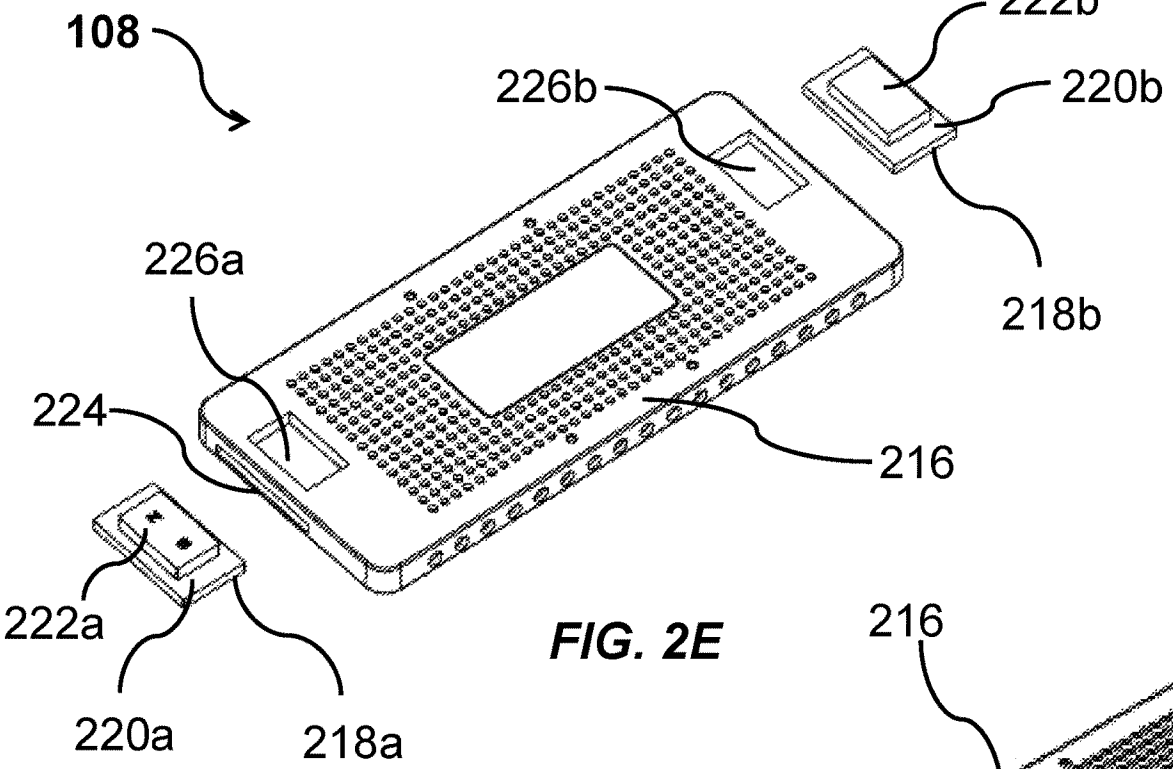
FIG. 2E shows an exploded perspective view of a carrier member of the head support assembly of FIG. 1A, according to an alternate embodiment.
Figure 2F:
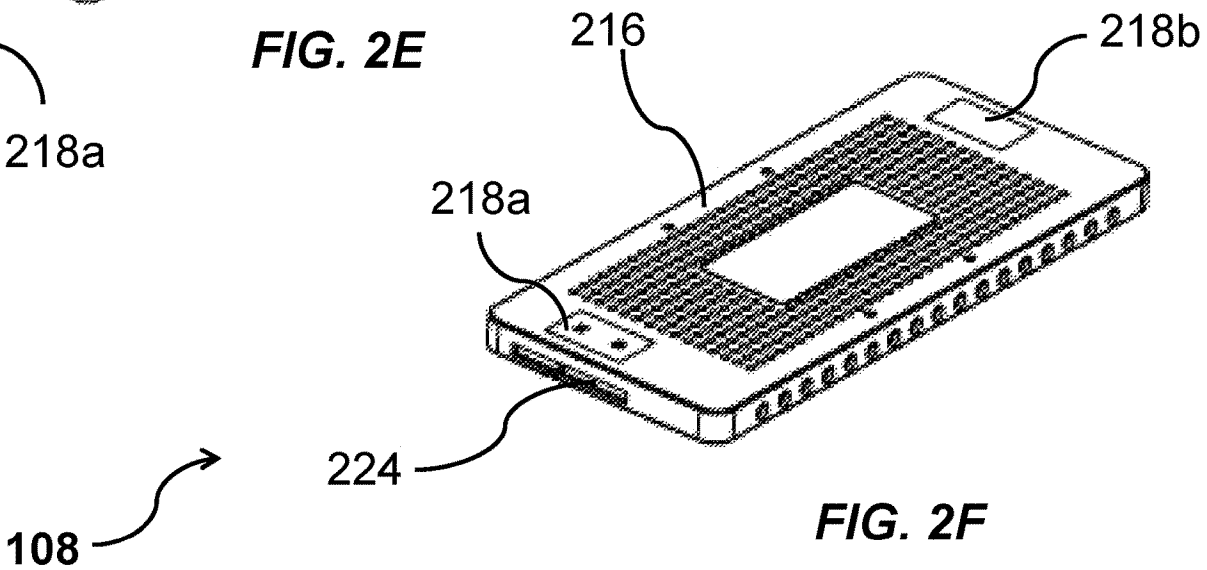
FIG. 2F shows a perspective view of the assembled carrier member of FIG. 2E.

FIG. 2E shows an exploded perspective view of a carrier member 216 of the head support assembly 100 of FIG. 1A according to an alternate embodiment, while FIG. 2F shows a perspective view of the assembled carrier member 216 of FIG. 2E. In this embodiment as shown in FIG. 2E, the carrier member 216 is configured to receive two magnet assemblies 218*a*, 218*b*. Each of the two magnet assemblies 218*a*, 218*b* includes a base 220*a*, 220*b* and a protrusion 222*a*, 222*b* extending from the base 220*a*, 220*b*. In a non-limiting implementation, the base 220*a*, 220*b* comprises a steel plate while the protrusion 222*a*, 222*b* comprises a permanent magnet. The magnet may be fixedly attached to the steel plate using an adhesive or bonder such as Loctite 326. The carrier member 216 may be removably attached to the aft section 114 and configured to securely retain the magnet assemblies 218*a*, 218*b* such that the magnet assemblies 218*a*, 218*b* are disposed at the aft section 114 proximate to the one or more magnetizable plate members 106 of the headrest 102.

The carrier member 216 also includes a plurality of cavities 224 corresponding to the magnet assemblies 218*a*, 218*b*. Each cavity 224 includes an opening 226*a*, 226*b* sized based on the cross-section of the protrusion 222*a*, 222*b*. In this way, the magnet assemblies 218*a*, 218*b* are disposed in the cavities 224 such that the protrusion 222*a*, 222*b* of each magnet is snugly received by a respective opening 226*a*, 226*b*, as shown in FIG. 2F.

Figure 2G:
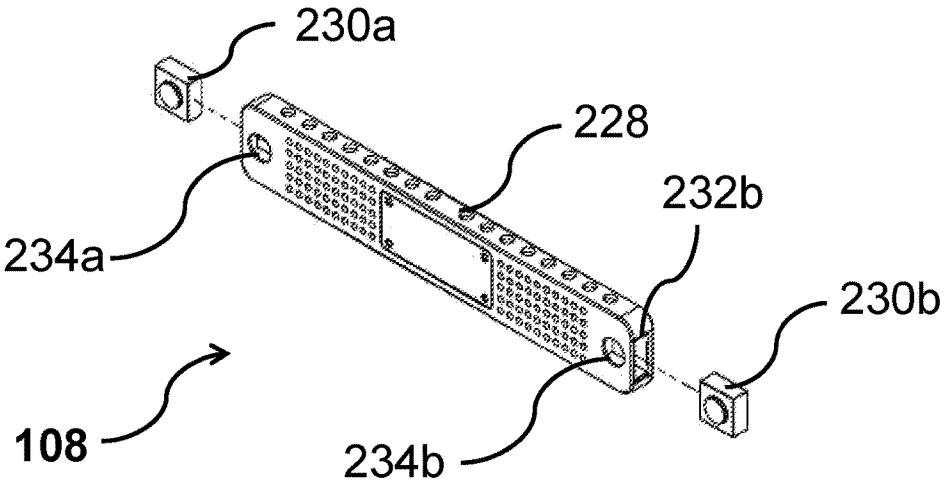
FIG. 2G shows an exploded perspective view of a carrier member of the head support assembly of FIG. 1A, according to an alternate embodiment
Figure 2H:
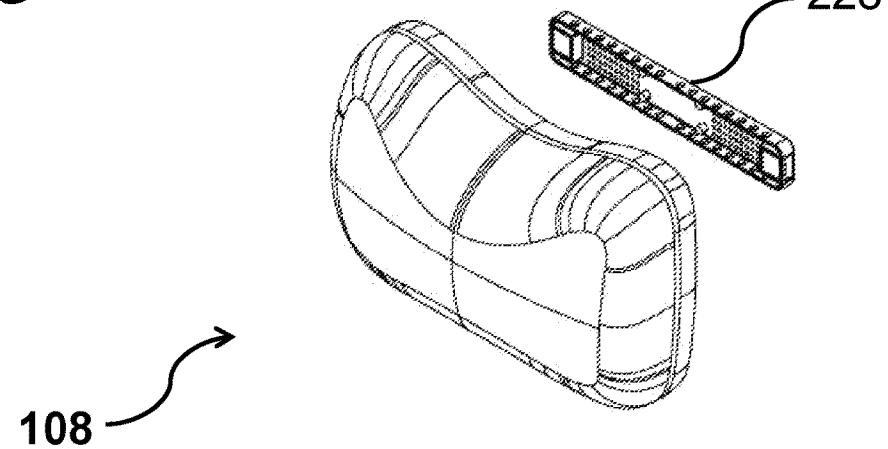
FIG. 2H shows a perspective view of the assembled carrier member of FIG. 2G with the cushion of FIG. 2A.

FIG. 2G shows an exploded perspective view of a carrier member 228 of the head support assembly 100 of FIG. 1A according to an alternate embodiment, while FIG. 2H shows a perspective view of the assembled carrier member 228 of FIG. 2G with the cushion 108 of FIG. 2A. The carrier member 228 in this embodiment is configured to receive two magnet assemblies 230*a*, 230*b*. The carrier member 228 includes a plurality of cavities 232*b* with openings 234*a*, 234*b* corresponding to the shape of the magnet assemblies 230*a*, 230*b*. The two magnet assemblies 230*a*, 230*b* may be of similar shape/construction to the magnet assemblies 110*a*, 110*b* of FIG. 2A but may have a higher magnetic strength. Accordingly, the carrier member 228 can have a smaller width compared to the carrier member 216 of FIG. 2E. The cushion 108 may therefore be lighter and contribute to reducing the overall weight of the cushion assembly.

Figure 3:
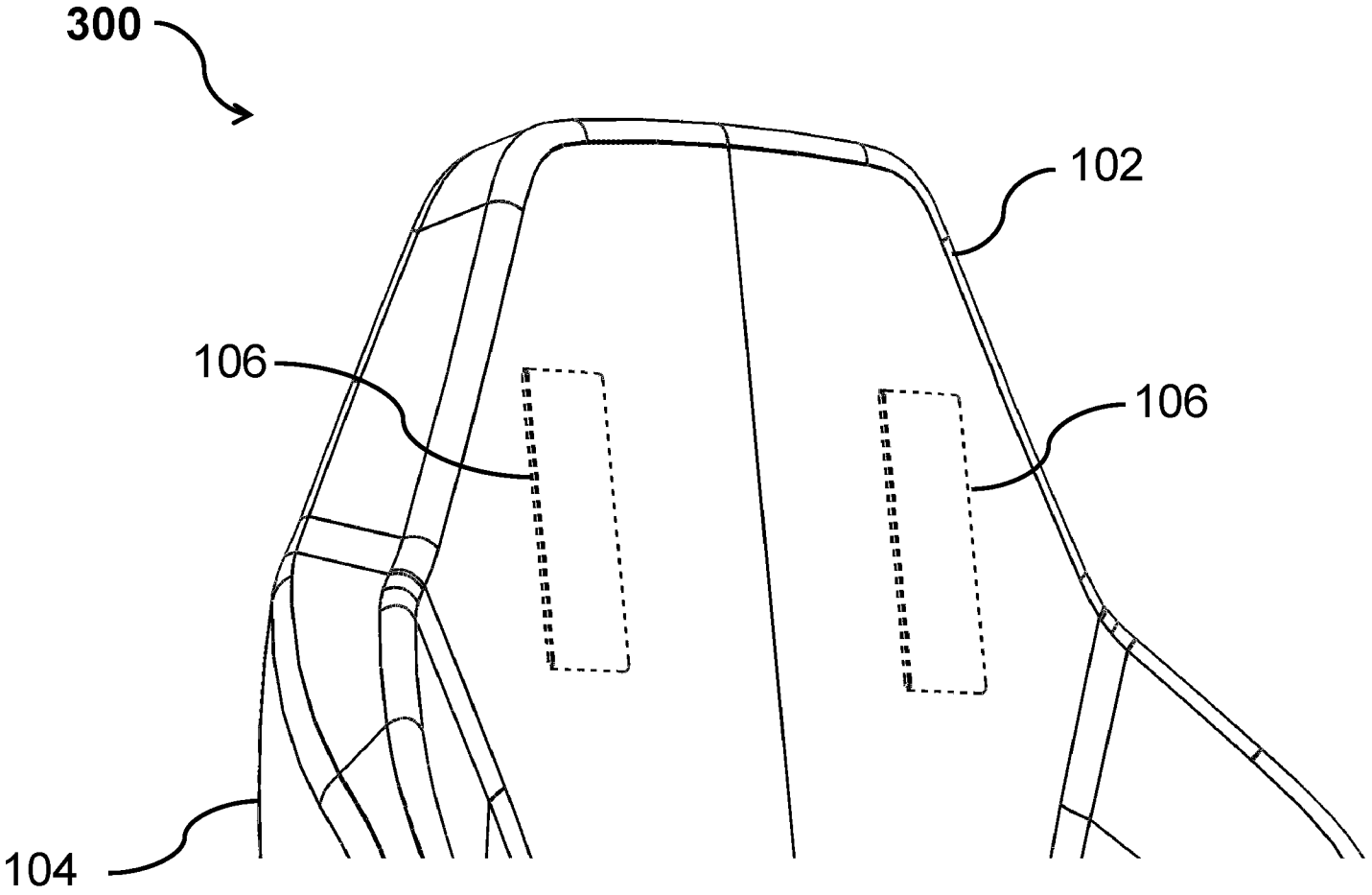
FIG. 3 shows a perspective view of the headrest and one or more magnetizable plate members of the head support assembly of FIG. 1A, according to an example embodiment.

FIG. 3 shows a perspective view 300 of the headrest 102 and one or more magnetizable plate members 106 of the head support assembly 100 of FIG. 1A, according to an example embodiment. As shown in FIG. 3, the headrest 102 is formed as part of the seatback 104. In other embodiments, the headrest 102 may be removable from the seatback 104 and can be adjusted vertically relative to the seatback 104. The one or more magnetizable plate members 106 shown in FIG. 3 includes a pair of rails parallel to a height direction of the seatback 104 such that the cushion 108 can be moved vertically along the headrest 102. In alternate embodiments, the one or more magnetizable plate members 106 may be a single metallic (for example, steel) piece which can allow the cushion 108 to be adjusted both vertically and horizontally relative to the seatback 104. In example embodiments, the size and/or position of the one or more magnetizable plate members 106 may be varied. For example, the one or more magnetizable plate members 106 may have longer rails to accommodate a greater vertical adjustability of the cushion 108.

The plate members 106 may be embedded to the headrest 102 at a predetermined depth such that headrest 102 can be aesthetically appealing while maintaining the magnetic attractive force of the magnets 110*a*, 110*b*, 110*c*, 110*d* to the plate members 106 at the same time. The position and the dimension (such as length and width) of the plate members 106 may be predetermined to indicate a position and adjustable range of the cushion 108 when it is attached to the headrest 102. For example, the plate members 106 can be positioned at a predetermined specific depth and position using guides and spacers inside a foam tool during overmolding with the fore surface 116 of the headrest 102.

In alternate embodiments, the plate members 106 can be embedded into the fore surface 116 to provide a better experience so that users will not feel the existence of the plate members 106 in the headrest 102 when leaning against it in the absence of the cushion 108. The embedment depth of the plate members 106 can be controlled to provide sufficient magnetic force interaction with the magnets 110*a*, 110*b*, 110*c*, 110*d*. The plate members 106 can also be positioned in the headrest 102 such that they are not in direct contact with a user's head. The thickness of the plate members 106 can be optimized by considering the overall weight of the product and the strength of magnetic force interaction with the magnets 110*a*, 110*b*, 110*c*, 110*d*.

In another example embodiment, the plate members 106 may be embedded in the cushion 108 while the magnets 110*a*, 110*b*, 110*c*, 110*d* are embedded in the headrest 102 near the fore surface 116. Such an arrangement still allows the cushion 108 to be magnetically attached to the headrest 102 and yet adjustable between different position relative to the headrest 102.

In another embodiment, the magnets may be installed on a steel plate which is then embedded in the cushion 108. Such an arrangement allows small magnets to be used while still providing the cushion 108 with adjustability relative to the headrest 102, as the steel plate embedded in the cushion 108 is magnetized by the magnets and can interact with the plate members 106 embedded in the headrest 102 to magnetically attach the cushion 108 to the headrest 102.

Figure 4:
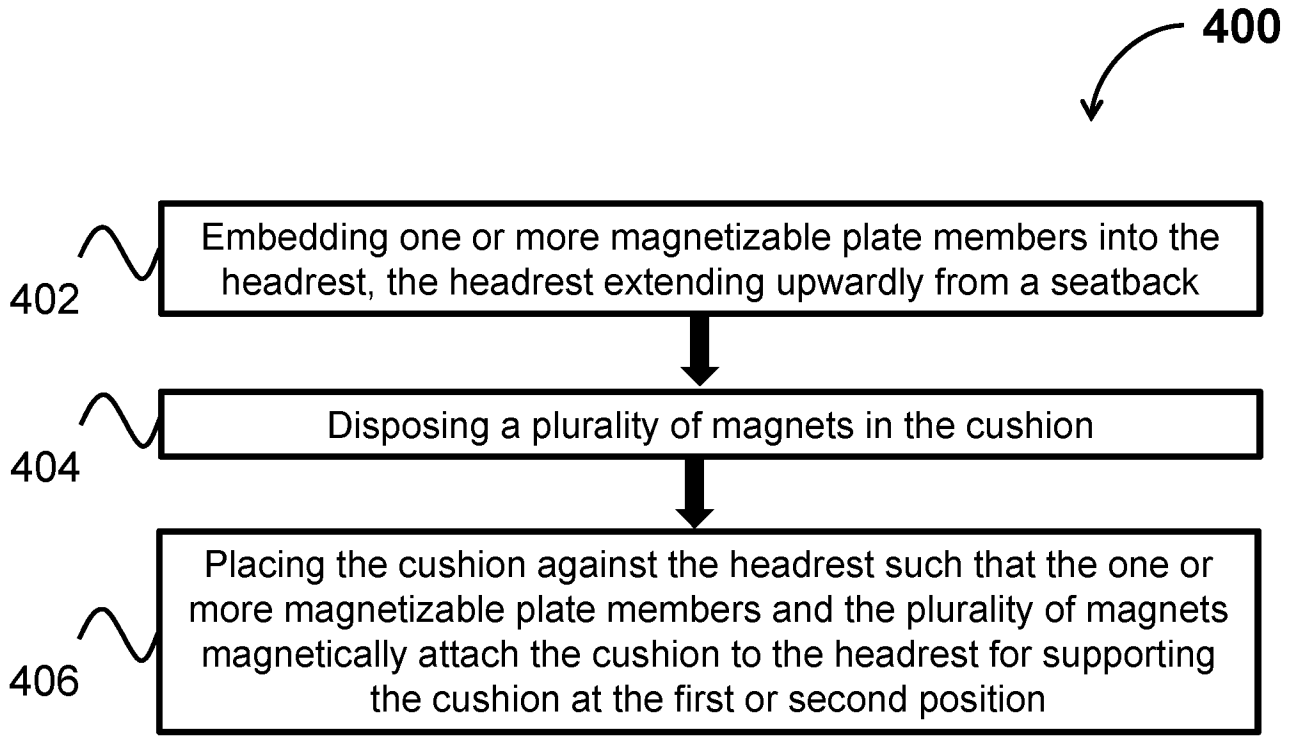
FIG. 4 shows a flowchart illustrating a method of supporting a cushion on a headrest, according to an example embodiment.

FIG. 4 shows a flowchart 400 illustrating a method of supporting a cushion on a headrest, according to an example embodiment. The method comprises, at step 402, embedding one or more magnetizable plate members into the headrest, the headrest extending upwardly from a seatback. At step 404, the method comprises disposing a plurality of magnets in the cushion and at step 406, the method comprises placing the cushion against the headrest such that the one or more magnetizable plate members and the plurality of magnets magnetically attach the cushion to the headrest for supporting the cushion at the first or second position.

The method of placing the cushion against the headrest may include slidingly abutting the aft section with a substantially flat fore surface of the headrest. Disposing the plurality of magnets in the cushion may include securely retaining magnets in the carrier member at the aft section proximate to the one or more magnetizable plate members of the headrest. Embedding the one or more magnetizable plate members into the headrest may include positioning the one or more magnetizable plate members adjacent the fore surface of the headrest.

Disposing the plurality of magnets in the cushion may include forming in the carrier member a plurality of cavities corresponding to the plurality of magnets, each cavity comprising an opening sized based on the cross-section of the protrusion; and disposing the magnets in the cavities such that the protrusion of each magnet is snugly received by a respective opening. Disposing the plurality of magnets in the pillow may further include positioning the magnets based on a position of the one or more plate member on the headrest.

The head support assembly 100 as described herein may provide a clean and neat device that can allow users to adjust to their desired position and held in place without the need for constant re-positioning. The head support assembly is durable and can also be used for prolonged a period of time as the magnetic strength is not easily lost. While exemplary embodiments have been presented in the foregoing detailed description of the invention, it should be appreciated that a vast number of variations exist.

It should further be appreciated that the exemplary embodiments are only examples, and are not intended to limit the scope, applicability, operation, or configuration of the invention in any way. Rather, the foregoing detailed description will provide those skilled in the art with a convenient road map for implementing an exemplary embodiment of the invention, it being understood that various changes may be made in the function and arrangement of elements and method of operation described in an exemplary embodiment without departing from the scope of the invention as set forth in the appended claims.

It will be appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive.

The invention claimed is:

1. A head support assembly comprising:

a headrest extending upwardly from a seatback, the headrest comprising one or more magnetizable plate members;

a cushion adjustable between a first position and a second position relative to the headrest, the cushion comprising a plurality of magnets, wherein the one or more magnetizable plate members and the plurality of magnets are configured to magnetically attach the cushion to the headrest for supporting the cushion at the first or second position, wherein the cushion comprises a deformable fore section, a substantially flat aft section, and a carrier member removably attached to the aft section, the carrier member configured to securely retain the plurality of magnets such that the plurality of magnets are disposed at the aft section proximate to the one or more magnetizable plate members of the headrest, and wherein the deformable fore section is configured to support a head of a user and the aft section is configured to slidingly abut a substantially flat fore surface of the headrest.

2. The head support assembly as claimed in claim 1, wherein the one or more magnetizable plate members are embedded adjacent the fore surface of the headrest.

3. The head support assembly as claimed in claim 2, wherein each magnet of the plurality of magnets comprises a base and a protrusion extending from the base, the protrusion having a cross-section smaller than a cross-section of the base.

4. The head support assembly as claimed in claim 3, wherein the carrier member comprises a plurality of cavities corresponding to the plurality of magnets, each cavity comprising an opening sized based on the cross-section of the protrusion, and wherein the plurality of magnets are disposed in the plurality of cavities such that the protrusion of each magnet is snugly received by a respective opening.

5. The head support assembly as claimed in claim 4, wherein the carrier member comprises a resilient material.

6. The head support assembly as claimed in claim 4, wherein the cushion comprises a plurality of recesses corresponding to the plurality of cavities, each recess based on the cross-section of the base, and wherein the plurality of magnets are disposed in the plurality of recesses such that the base of each magnet is snugly received by a respective recess.

7. A method of supporting a cushion on a headrest, the cushion being adjustable between a first position and a second position relative to the headrest, the method comprising:

embedding one or more magnetizable plate members into the headrest, the headrest extending upwardly from a seatback;

disposing a plurality of magnets in the cushion; and placing the cushion against the headrest such that the one or more magnetizable plate members and the plurality of magnets magnetically attach the cushion to the headrest for supporting the cushion at the first or second position, wherein the cushion comprises a deformable fore section, a substantially flat aft section, and a carrier member removably attached to the aft section, the deformable fore section configured to support a head of a user, and wherein placing the cushion against the headrest comprises slidingly abutting the aft section with a substantially flat fore surface of the headrest, and wherein disposing the plurality of magnets in the cushion comprises securely retaining magnets in the carrier member at the aft section proximate to the one or more magnetizable plate members of the headrest.

8. The method as claimed in claim 7, wherein embedding the one or more magnetizable plate members into the headrest comprises positioning the one or more magnetizable plate members adjacent the fore surface of the headrest.

9. The method as claimed in claim 8, wherein each magnet of the plurality of magnets comprises a base and a protrusion extending from the base, the protrusion having a cross-section smaller than a cross-section of the base.

10. The method as claimed in claim 9, wherein disposing the plurality of magnets in the cushion comprises:

forming in the carrier member a plurality of cavities corresponding to the plurality of magnets, each cavity comprising an opening sized based on the cross-section of the protrusion; and disposing the plurality of magnets in the plurality of cavities such that the protrusion of each magnet is snugly received by a respective opening.

11. The method as claimed in claim 10, wherein the carrier member comprises a resilient material.

12. The method as claimed in claim 11, further comprising:

forming a plurality of recesses corresponding to the plurality of cavities, each recess based on the cross-section of the base, and disposing the plurality of magnets in the plurality of recesses such that the base of each magnet is snugly received by a respective recess.

13. The method as claimed in claim 12, wherein disposing the plurality of magnets in the cushion further comprises positioning the plurality of magnets based on a position of the one or more magnetizable plate members on the headrest.

14. The method as claimed in claim 13, further comprising selecting a magnetic strength of the plurality of magnets based on a weight of the cushion.

* * * * *